US011105204B2

(12) United States Patent
Di Paola et al.

(10) Patent No.: US 11,105,204 B2
(45) Date of Patent: Aug. 31, 2021

(54) TURBINE ASSEMBLY

(71) Applicant: PRATT & WHITNEY CANADA CORP., Longueuil (CA)

(72) Inventors: Franco Di Paola, Montreal (CA); Guy Lefebvre, St-Bruno-de-Montarville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 372 days.

(21) Appl. No.: 16/437,085

(22) Filed: Jun. 11, 2019

(65) Prior Publication Data

US 2020/0392849 A1 Dec. 17, 2020

(51) Int. Cl.

| | |
|---|---|
| ***F01D 5/06*** | (2006.01) |
| ***F01D 5/02*** | (2006.01) |
| *F01D 5/34* | (2006.01) |

(52) U.S. Cl.

CPC ..... *F01D 5/066* (2013.01); *F01D 5/026* (2013.01); *F01D 5/025* (2013.01); *F01D 5/34* (2013.01); *F05D 2220/36* (2013.01); *F05D 2230/60* (2013.01); *F05D 2240/24* (2013.01); *F05D 2260/31* (2013.01)

(58) Field of Classification Search

None

See application file for complete search history.

(56) References Cited

U.S. PATENT DOCUMENTS 3,622,185 A * 11/1971 Rosan, Sr. ..... F16D 1/06 403/316
4,901,523 A * 2/1990 Huelster ..... F01D 5/026 416/198 A
5,356,236 A 10/1994 Duboue
8,186,903 B2 5/2012 Makin et al.
8,186,939 B2 5/2012 Lecuyer et al.
8,246,255 B2 8/2012 Raberin et al.
8,517,687 B2 8/2013 Benjamin et al.
8,764,390 B2 7/2014 Humhauser
2011/0052372 A1 3/2011 Lecuyer et al.
2013/0156589 A1 6/2013 Paquet et al.
2015/0260044 A1 9/2015 Costamagna et al.

FOREIGN PATENT DOCUMENTS

CN 103603877 B 2/2014
WO 2014195091 A1 12/2014

OTHER PUBLICATIONS

English translation of China Patent Document No. CN 103603877 dated Feb. 26, 2014, https://patents.google.com/patent/CN103603877B/en?oq=CN103603877B, accessed on Jun. 11, 2019.

European Patent Office, Communication dated Oct. 14, 2020 re: application No. 20179235.5.

* cited by examiner

*Primary Examiner* — Juan G Flores

(74) *Attorney, Agent, or Firm* — Norton Rose Fulbright Canada LLP

(57) ABSTRACT

Turbine and other bladed disc assemblies and associated methods are disclosed. In an embodiment, a turbine assembly includes a rotor and a turbine disc secured to the rotor via a nut and a deformable retainer. The nut is threadably engaged with the rotor to secure the turbine disc to the rotor. The retainer is deformed to co-operatingly engage with a periphery of the nut and configured to hinder rotation of the nut relative to the rotor.

18 Claims, 12 Drawing Sheets

TURBINE ASSEMBLY

TECHNICAL FIELD

The disclosure relates generally to gas turbine engines, and more particularly to assemblies that include one or more turbines and/or other bladed discs.

BACKGROUND

Turbine assemblies in gas turbine engines can include turbine discs that are attached together and stacked in series axially along a shaft. The use of existing attachment mechanisms for assembling such turbine assemblies can result in turbine assemblies having significant axial length.

SUMMARY

In one aspect, the disclosure describes a turbine assembly comprising:

a rotor;

a turbine disc;

a nut threadably engaged with the rotor and securing the turbine disc to the rotor; and a deformed retainer co-operatingly engaging with a periphery of the nut and configured to hinder rotation of the nut relative to the rotor.

In another aspect, the disclosure describes a gas turbine engine comprising:

a rotor;

a bladed disc;

a nut threadably engaged with the rotor and securing the bladed disc to the rotor; and a deformed retainer co-operatingly engaging with a shoulder of the nut and configured to hinder rotation of the nut relative to the rotor.

In a further aspect, the disclosure describes a method for securing a bladed disc to a rotor. The method comprises:

securing the bladed disc to the rotor by threadably engaging a nut with the rotor; and deforming a retainer to cause the retainer to engage the nut, the retainer being engaged with the rotor to hinder rotation of the retainer relative to the rotor, the deforming including driving a tool against the retainer to cause deformation of the retainer, driving the tool including using the nut to apply a force on the tool.

Further details of these and other aspects of the subject matter of this application will be apparent from the detailed description included below and the drawings.

DESCRIPTION OF THE DRAWINGS

Reference is now made to the accompanying drawings, in which:

FIG. 6. is a perspective view of an exemplary nut of the bladed disc assemblies of FIG. 2 or 5;

DETAILED DESCRIPTION

The following disclosure relates to bladed disc assemblies of gas turbine engines and methods for assembling such bladed disc assemblies. In some embodiments, the assemblies and methods disclosed herein may facilitate more axially compact arrangements of bladed disc assemblies compared to existing arrangements. More axially compact arrangements of bladed disc assemblies may also facilitate the accommodation of temperature variations inside gas turbines. For example, a more axially compact arrangement may reduce thermal influences on a nut preload necessary to maintain required clamping loads of a bladed disk assembly during gas turbine operation, as compared to a less axially compact arrangement.

Aspects of various embodiments are described in relation to the figures.

Figure 1:
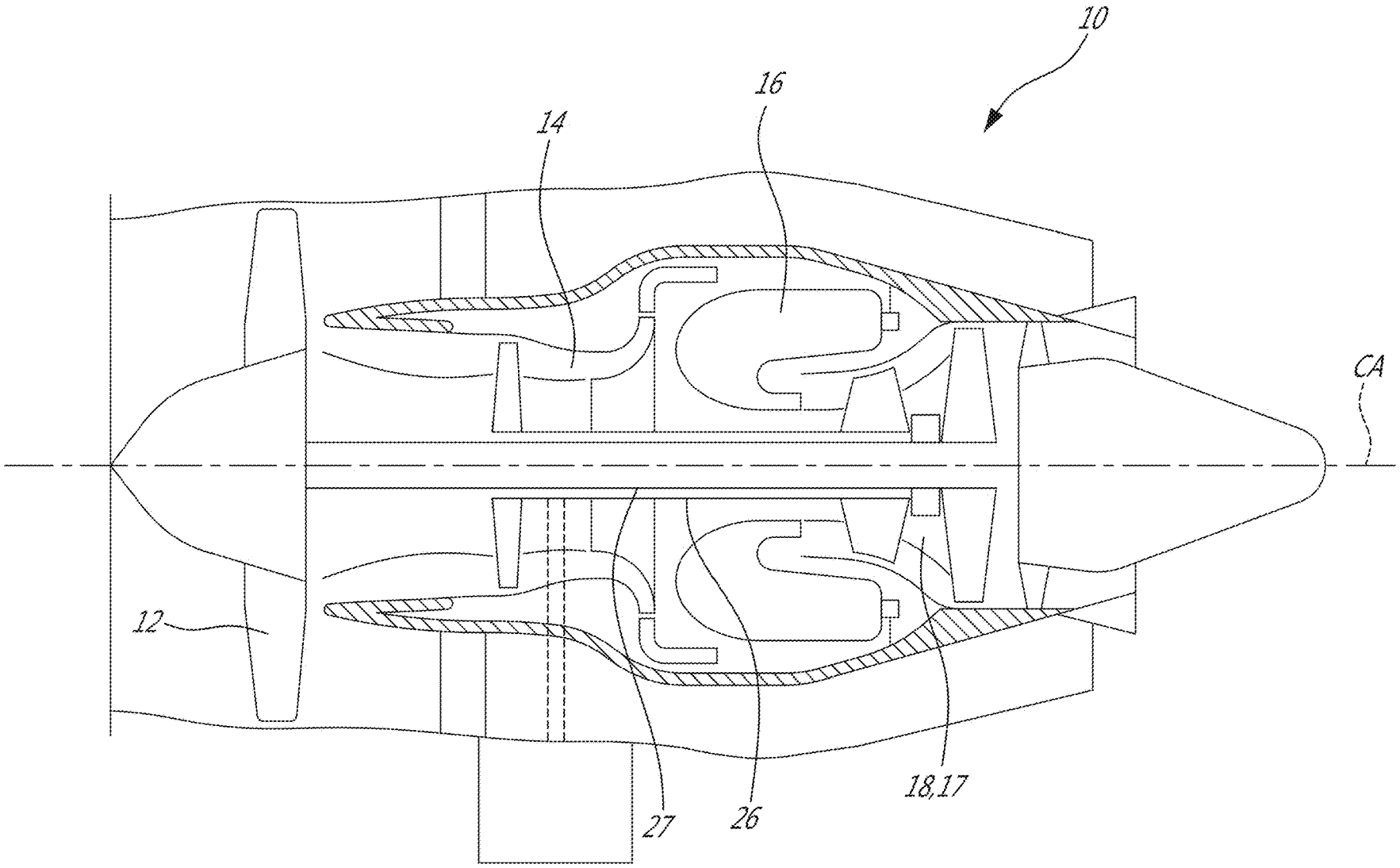
FIG. 1 is a schematic cross-sectional view of a turbofan gas turbine engine having one or more bladed disc assemblies as disclosed herein.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. In some embodiments, engine 10 may be a turbo-fan engine. However, it is understood that aspects of the present disclosure are applicable to other types of engines such as turboprop and turbo-shaft for example.

Turbine section 18 may include one or more bladed disc assemblies 17. In various embodiments, bladed disc assembly 17 may be part of a high-pressure turbine section of engine 10 and may be drivingly coupled to high-pressure shaft 26 of engine 10. In some embodiments, bladed disc assembly 17 may be part of a low-pressure turbine section of engine 10 and may be drivingly coupled to low-pressure shaft 27 of engine 10. High-pressure shaft 26 and low-pressure shaft 27 may extend axially along central axis CA of engine 10 and may be substantially coaxial.

Figure 2:
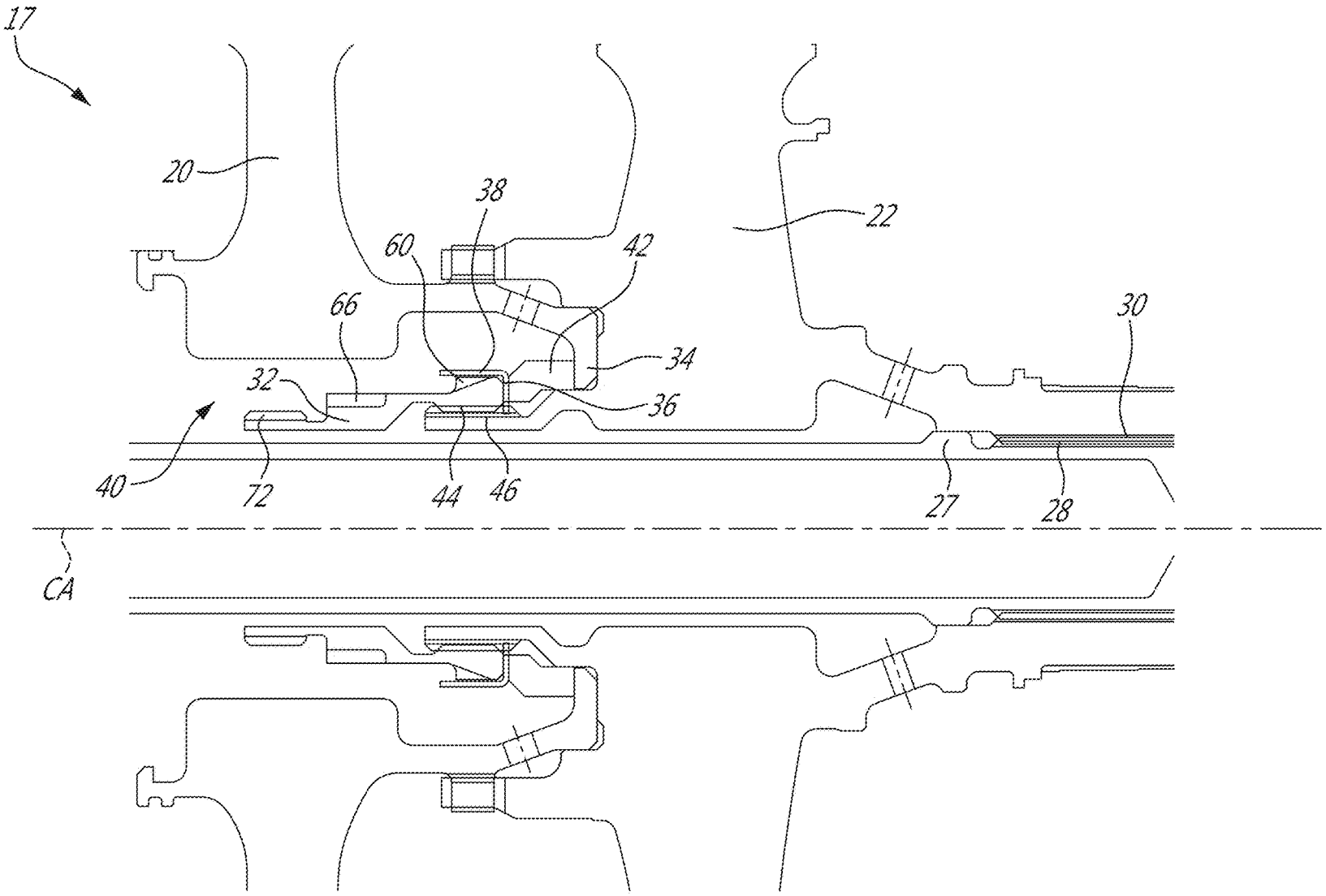
FIG. 2 is an enlarged cross-sectional view of part of a turbine section of the engine shown in FIG. 1 incorporating an exemplary bladed disc assembly as disclosed herein.
Figure 3:
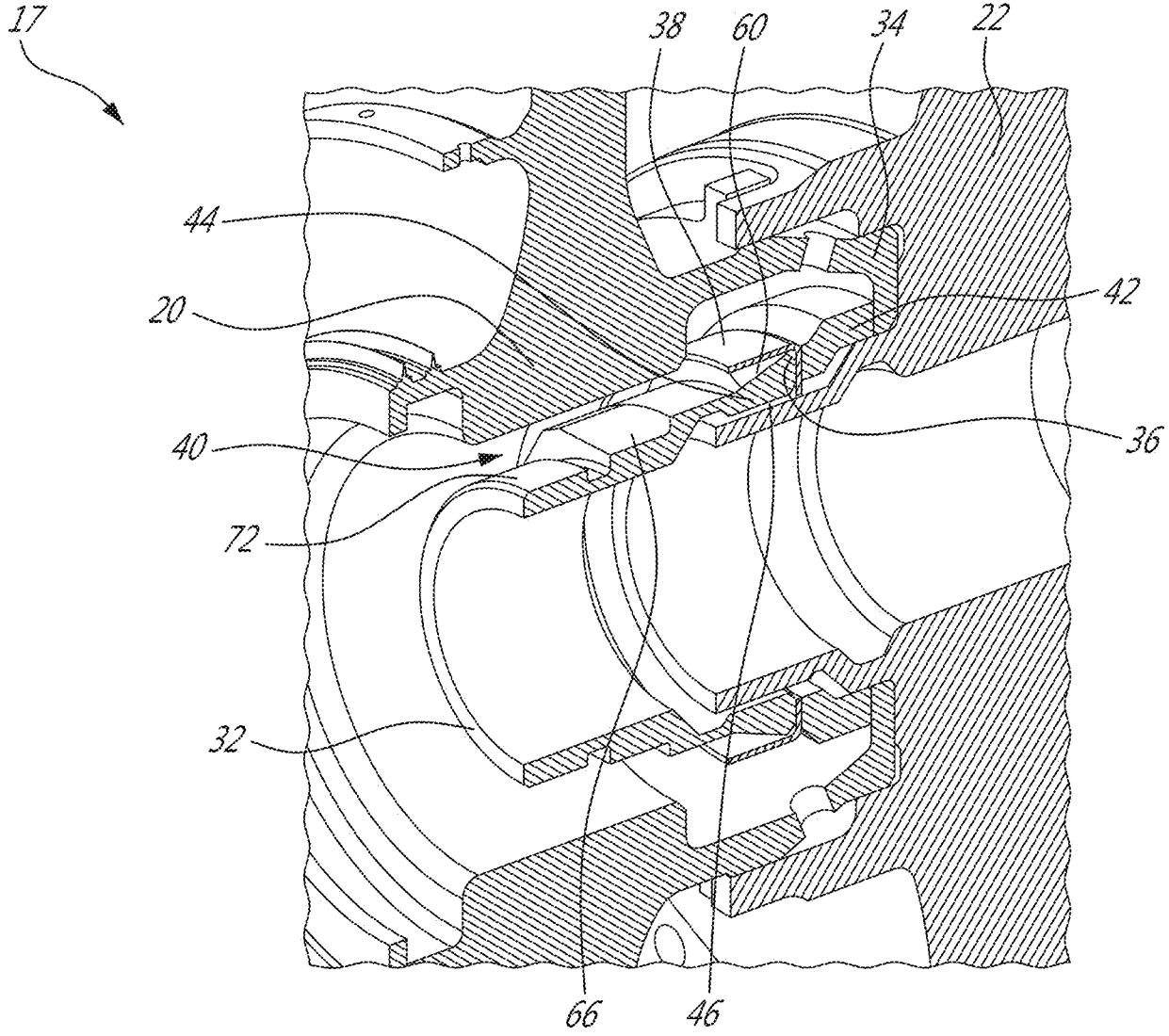
FIG. 3 is a perspective cross-sectional view of the part of the turbine section shown in FIG. 2.

FIG. 2 is an enlarged cross-sectional view of part of the turbine section 18 of engine 10. FIG. 3 is a perspective view of part of turbine section 18 shown in FIG. 2. Bladed disc assembly 17 may include bladed disc 20 drivingly connected to rotor 22. For example, bladed disc 20 may be connected for torque transfer and common rotation with rotor 22. Bladed disc 20 may be a turbine disc. However, aspects of this disclosure are applicable to other types of bladed discs that are not necessarily part of turbine section 18 of engine 10. For example, blade disc 20 may be part of compressor section 14 of engine 10. Bladed disc 20 may include a hub and a plurality of blades extending radially outwardly from the hub and being circumferentially distributed about the hub.

Bladed disc assembly 17 may be a turbine assembly. As used herein, the term "rotor" is intended to encompass one or more rotatable components (e.g., shaft(s) and/or other bladed disc(s)) of engine 10 drivingly connected to bladed disc 20 to allow torque transfer between bladed disc 20 and rotor 22. For example, rotor 22 may include another bladed disc drivingly connected to low-pressure shaft 27. In some embodiments, rotor 22 may include a plurality of drivingly connected turbine discs drivingly connected to low-pressure shaft 27.

Bladed disc 20 may be rotatably driven by the flow of combustion gases impinging on the blades of bladed disc 20 and the resulting torque generated by bladed disc 20 may be transferred to low-pressure shaft 27 via rotor 22 (e.g., turbine or other bladed disc). In other words, bladed disc 20 may be indirectly connected to low-pressure shaft 27 via rotor 22 as an intermediate component.

In some embodiments, low-pressure shaft 27 may be drivingly connected rotor 22 by means of a splined connection having external splines 28 formed on low-pressure shaft 27 and complementary internal splines 30 formed on rotor 22.

Bladed disc 20 may be secured to rotor 22 by means of nut 32 engaged with rotor 22 such that portion 34 of bladed disc 20 may be secured (e.g., clamped) between rotor 22 and shoulder 36 of nut 32. The shoulder 36 may have a generally circular periphery with one or more recesses 60 formed therein. Nut 32 may be engaged with rotor 22 to allow clamping of portion 34 of bladed disc 20 between rotor 22 and shoulder 36 of nut 32. Nut 32 may include threads 44 formed on nut 32 for threadable engagement with complementary threads 46 of rotor 22 such that nut 32 may be threadably engaged with rotor 22 and torque to a suitable preload. Threads 44 on nut 32 may be internal threads and threads 46 on rotor 22 may be external threads. Shoulder 36 of nut 32 may be substantially encased by deformable retainer 38. Nut 32 may be substantially disposed inside central bore 40 of bladed disc 20. Central bore 40 may be defined in the hub of bladed disc 20.

In some embodiments, the engagement of nut 32 with rotor 22 may include one or more intermediated components clamped between nut 32 and rotor 22. In some embodiments, spacer 42 may be disposed between rotor 22 and nut 32. The combination of nut 32, deformable retainer 38, and spacer 42 may be disposed inside central bore 40 of bladed disc 20.

Figure 4:
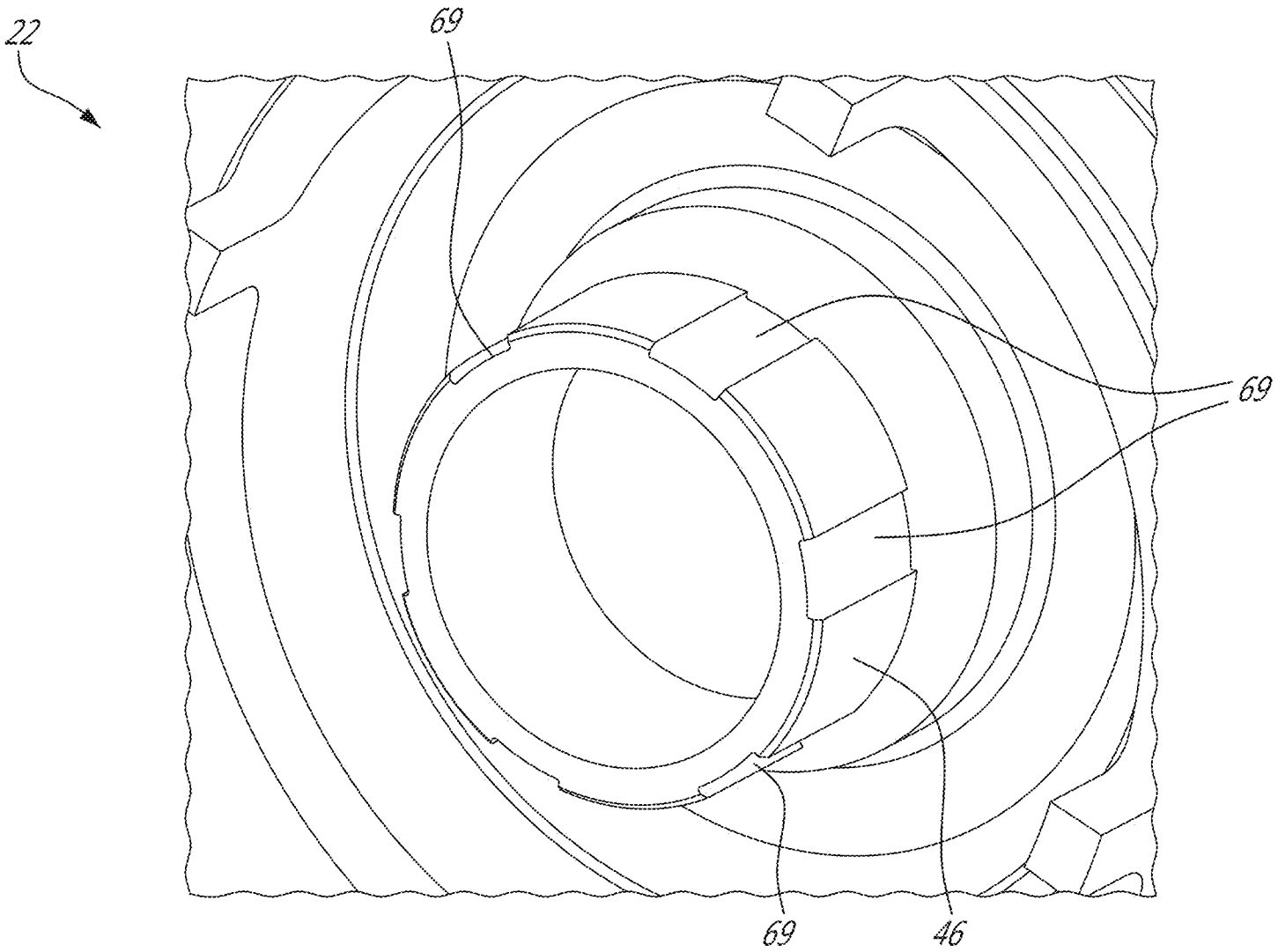
FIG. 4 is a perspective view of a portion of a rotor which engages with a nut and which locks with a deformable retainer.

FIG. 4 is a perspective view of a portion of the rotor 22. The portion is configured to engage with the nut 32 and allow interlocking with the deformable retainer 38. The nut 32 may threadably engage with the rotor 22 via externally threaded portion 46 on the rotor 22. The deformable retainer 38 may engage with the rotor 22 via keyways 69 formed in externally threaded portion 46 and complementary tabs 71 (see FIG. 7A) on the deformable retainer 38.

Figure 5:
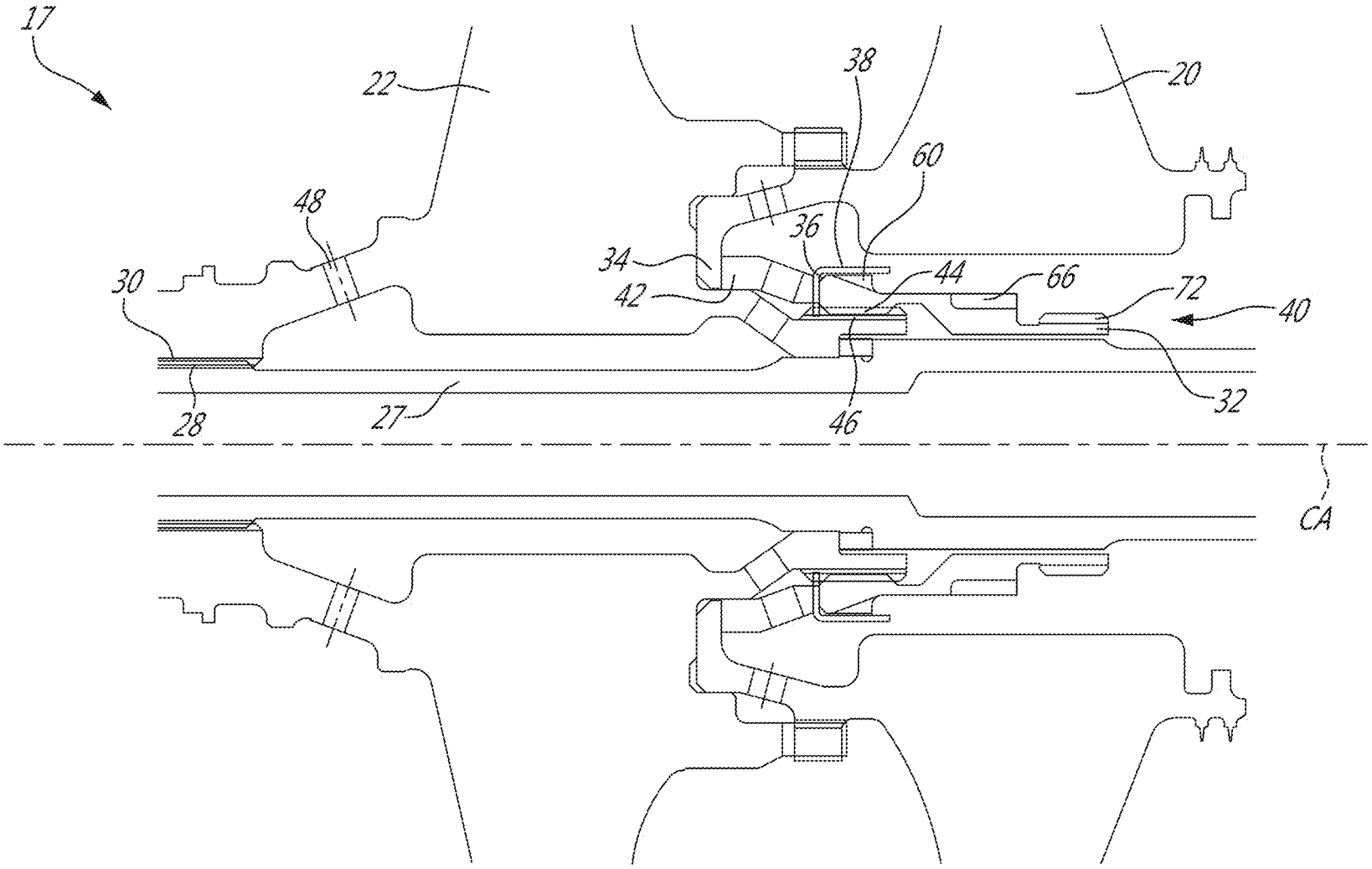
FIG. 5 is an enlarged cross-sectional view of part of the turbine section of the engine shown in FIG. 1 incorporating another exemplary bladed disc assembly as disclosed herein.
Figure 5:
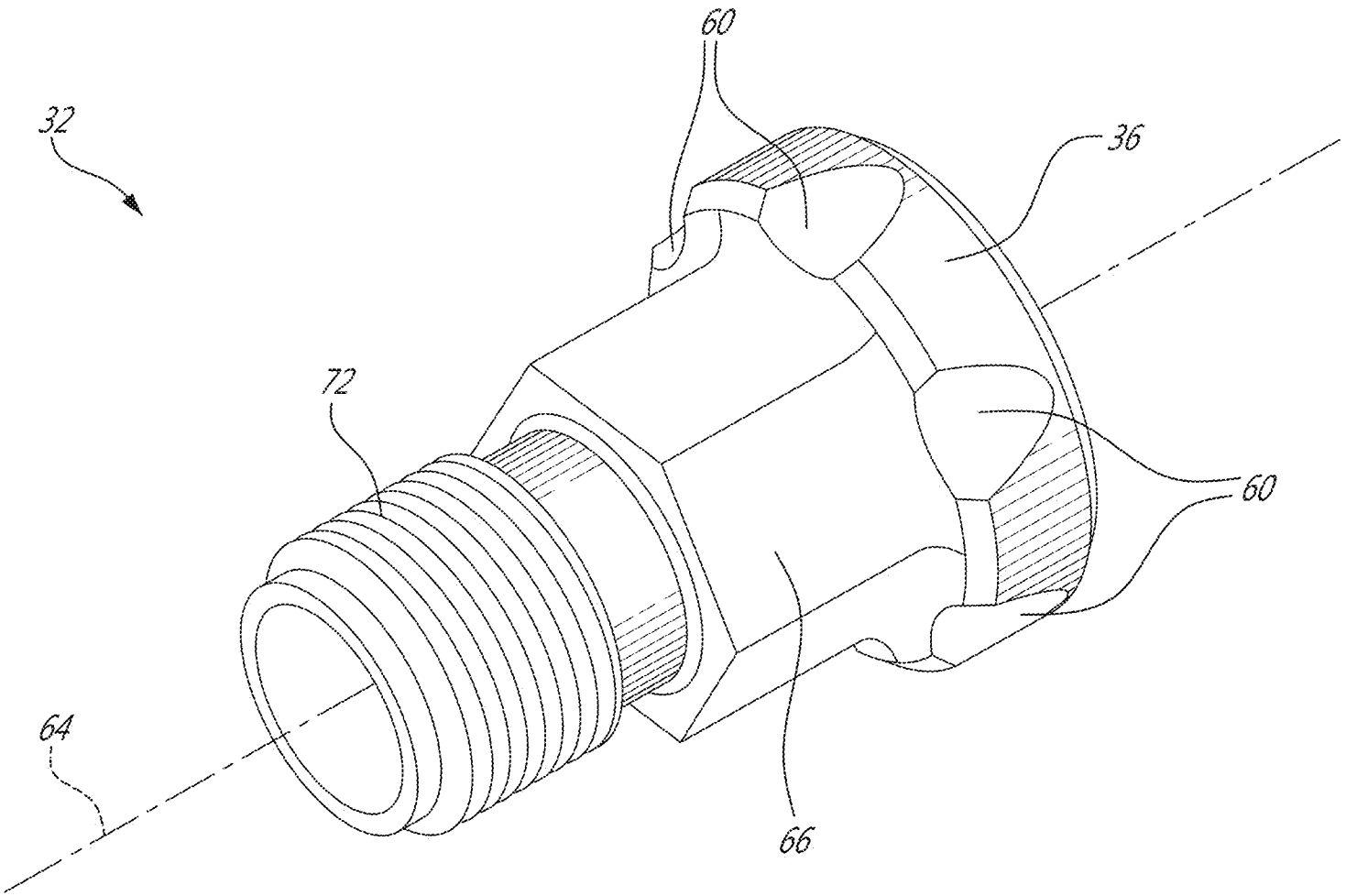

FIG. 5 is an enlarged cross-sectional view of part of another bladed disc assembly 17 where like elements have been identified using like reference numerals.

FIG. 6 is a perspective view of an exemplary nut 32. One or more recesses 60 may be formed in shoulder 36 of nut 32. In some embodiments, shoulder 36 may be scalloped. In some embodiments, each recess 60 may be substantially axially tapered with respect to a direction parallel with central axis 64 of nut 32. In some embodiments, the direction may be towards a portion of nut 32 distal from shoulder 36.

Nut 32 may include locking portion 66 located adjacent to shoulder 36 having recesses 60. Locking portion 66 may engage with tool 68 (shown in FIG. 8) for deforming retainer 38 such that the rotation of a portion of tool 68 relative to nut 32 is hindered during use of tool 68. In some embodiments, locking portion 66 may have an hexagonal (or other non-circular) outer cross-sectional profile transverse to the central axis 64 of nut 32.

Nut 32 may have a tool-engagement portion (e.g., threaded portion 72) located adjacent locking portion 66. The tool-engagement portion may permit engagement of tool 68 with nut 32 to facilitate the driving of tool 68 relative to nut 32 when causing deformation of retainer 38. The tool-engagement portion of nut 32 may include threaded portion 72 for use with tool 68. Threaded portion 72 may have external threads but it is understood that threaded portion 72 may instead have internal threads. First threaded portion 44 of nut 32 and second threaded portion 72 of nut 32 may be disposed at opposite axial ends of nut 32 with respect to central axis 64 of nut 32. Nut 32 can have central passage 70 defined therethrough. In some embodiments, central passage 70 can have a diameter that is larger than at least part of low-pressure shaft 27 to permit nut 32 to be inserted over the applicable part of low-pressure shaft 27 as shown in FIG. 5.

Figure 7B:
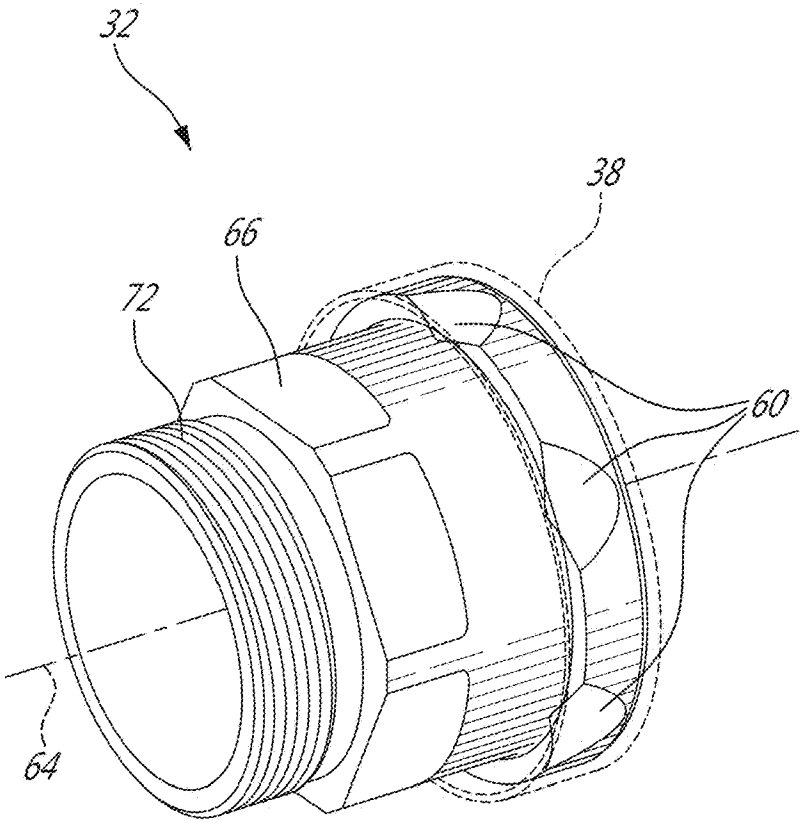
FIGS. 7A and 7B are perspective views of the nut in combination with a deformable retainer in an undeformed state.
Figure 7A:
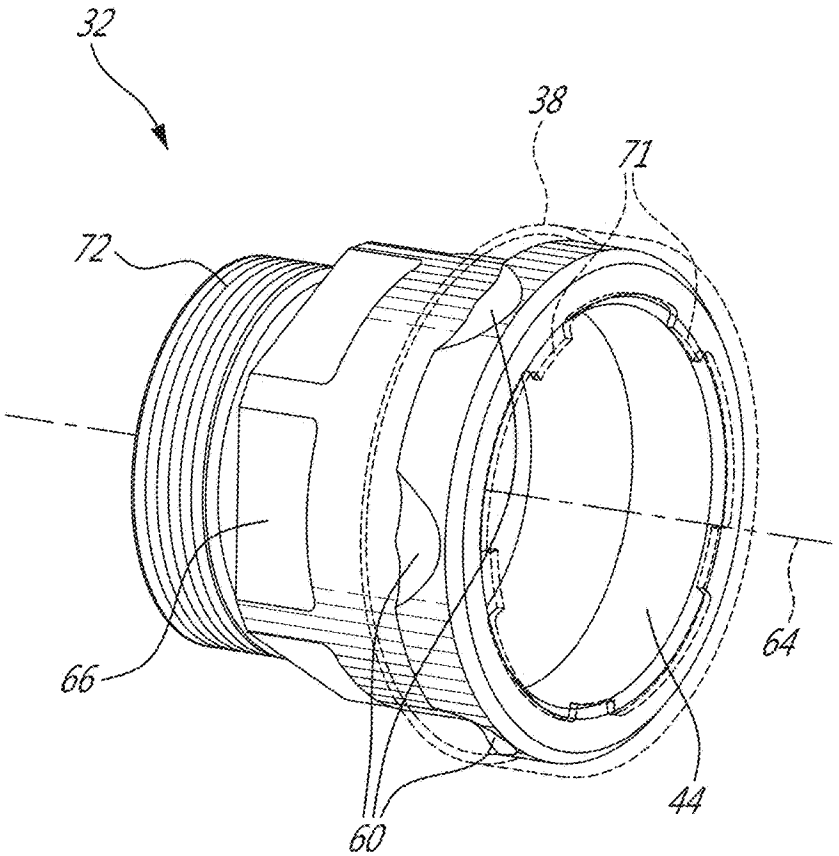

FIG. 7A and FIG. 7B are perspective views of an exemplary nut 32 in combination with the undeformed deformable retainer 38. Retainer 38 may substantially encase shoulder 36 of nut 32 in such a manner as to cover recesses 60 formed in shoulder 36. Deformable retainer 38 may be formed of a material that can be plastically deformed into recesses 60 defined in shoulder 36 by means of tool 68. For example, retainer 38 may be made from a metallic material (e.g., steel) having a suitable ductility. Deformable retainer 38 in an undeformed state may be annular and cup-shaped and fit over shoulder 36 of nut 32. Deformable retainer 38 may overhang recesses 60 with a gap defined between the overhanging portion and the recesses 60.

In other embodiments, undeformed deformable retainer 38 may include a washer assembly. The washer assembly may have a deformable ring with opposing and substantially flat surfaces with a flat surface in substantial contact with the shoulder 36. The deformable ring may include a plurality of tabs extending radially inwardly from the inner circumference of the deformable ring. Such tabs may serve to extend into and engage with respective cooperating features formed in rotor 22 in order to rotatably lock the deformable ring onto rotor 22 and hinder rotation of the deformable ring relative to rotor 22. Such features formed in rotor 22 may, for example, be suitable keyways 69 formed in externally threaded portion 46 of rotor 22 for receiving the tabs. The washer assembly may include a retaining ring to prevent lateral movement of the deformable ring. The retaining ring may include a substantially hollow cylinder encasing the deformable ring and a portion of the nut 32. The retaining ring may have a tightening mechanism to increase radial forces on the encased deformable ring and portion of nut 32.

Retainer 38 may have one or more tabs 71 extending radially inwardly from an annular portion of retainer 38.

Such tabs 71 may serve to extend into and engage with respective cooperating features formed in rotor 22 in order to rotatably lock retainer 38 onto rotor 22 and hinder rotation of retainer 38 relative to rotor 22. Such features formed in rotor 22 may, for example, be suitable keyways 69 (see FIG. 4) formed in externally threaded portion 46 of rotor 22 for receiving tabs 71. Accordingly, retainer 38 may be secured to rotor 22 by way of retainer 38 being clamped between nut 32 and optional spacer 42 and also being hindered from rotating relative to rotor 22 by way of tabs 71 rotatably secured by keyways 69.

Figure 8:
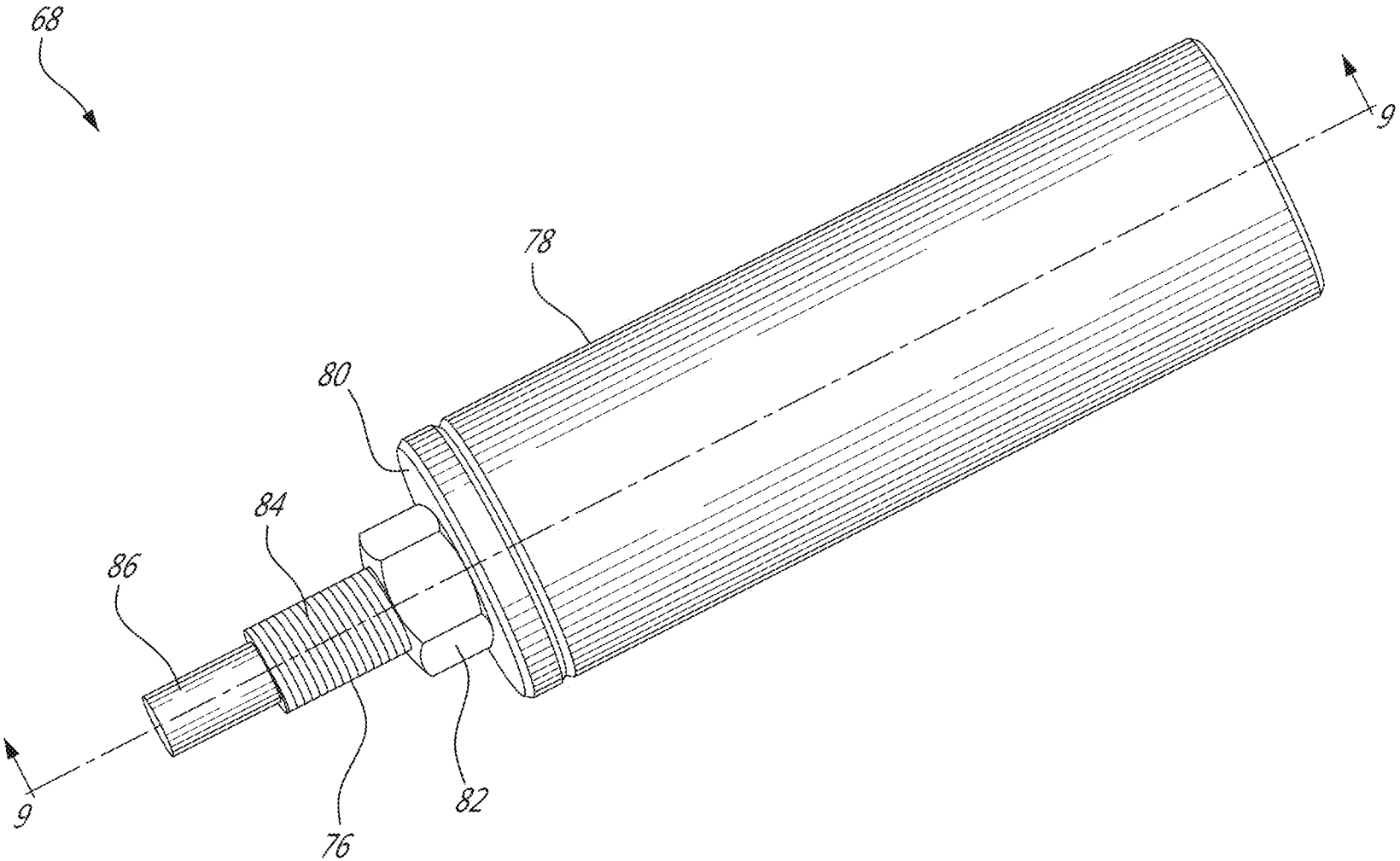
FIG. 8 is a perspective view of a tool used to deform the deformable retainer to cause engagement of the retainer with the nut.

FIG. 8 is perspective view of an exemplary tool 68 used to deform (e.g., crimp) deformable retainer 38 into recesses 60 formed in nut 32. Tool 68 may have inner shaft 76 slidingly receivable within hollow outer cylinder 78. Tool 68 may further include cap 80 covering one axial end of outer cylinder 78. Cap 80 may have a hole therethrough adapted to allow a portion of inner shaft 76 to pass therethrough. Tool 68 may include means to enable linear displacement of inner shaft 76 relative to outer cylinder 78. For example, nut 82 may be threadably engaged with externally threaded portion 84 of inner shaft 76 through the hole in cap 80. Inner shaft 76 may have axial end 86 adapted to co-operate with means hindering rotation of inner shaft 76. In some embodiments, outer axial end 86 may have a hexagonal cross-sectional profile adapted to engage with a suitable wrench.

Figure 9A:
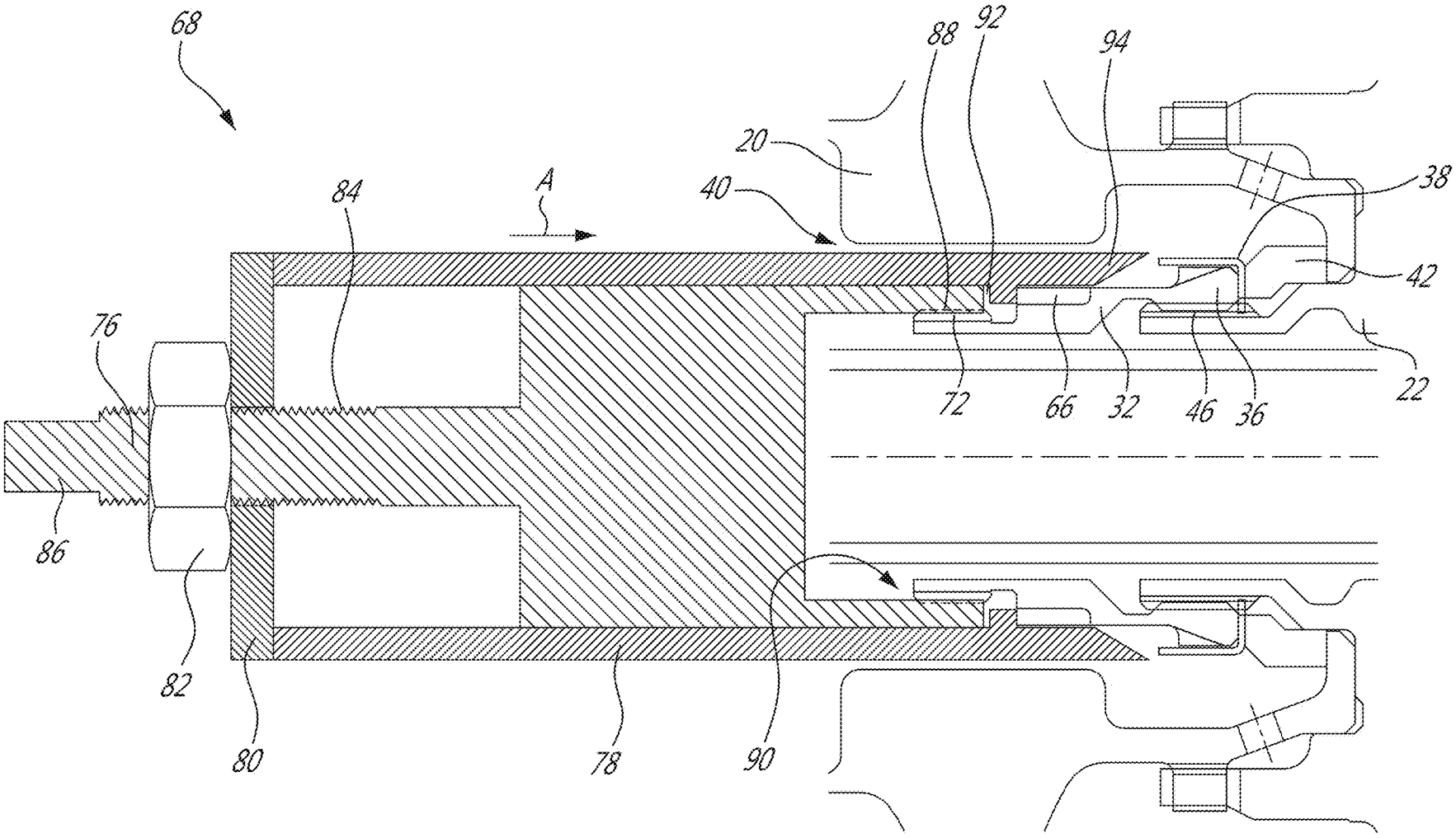
FIG. 9A is cross-sectional view of the tool shown in FIG. 8 taken along line 9-9 in FIG. 8, shown inserted inside a central bore of a bladed disc and in a state prior to deforming the deformable retainer.
Figure 9B:
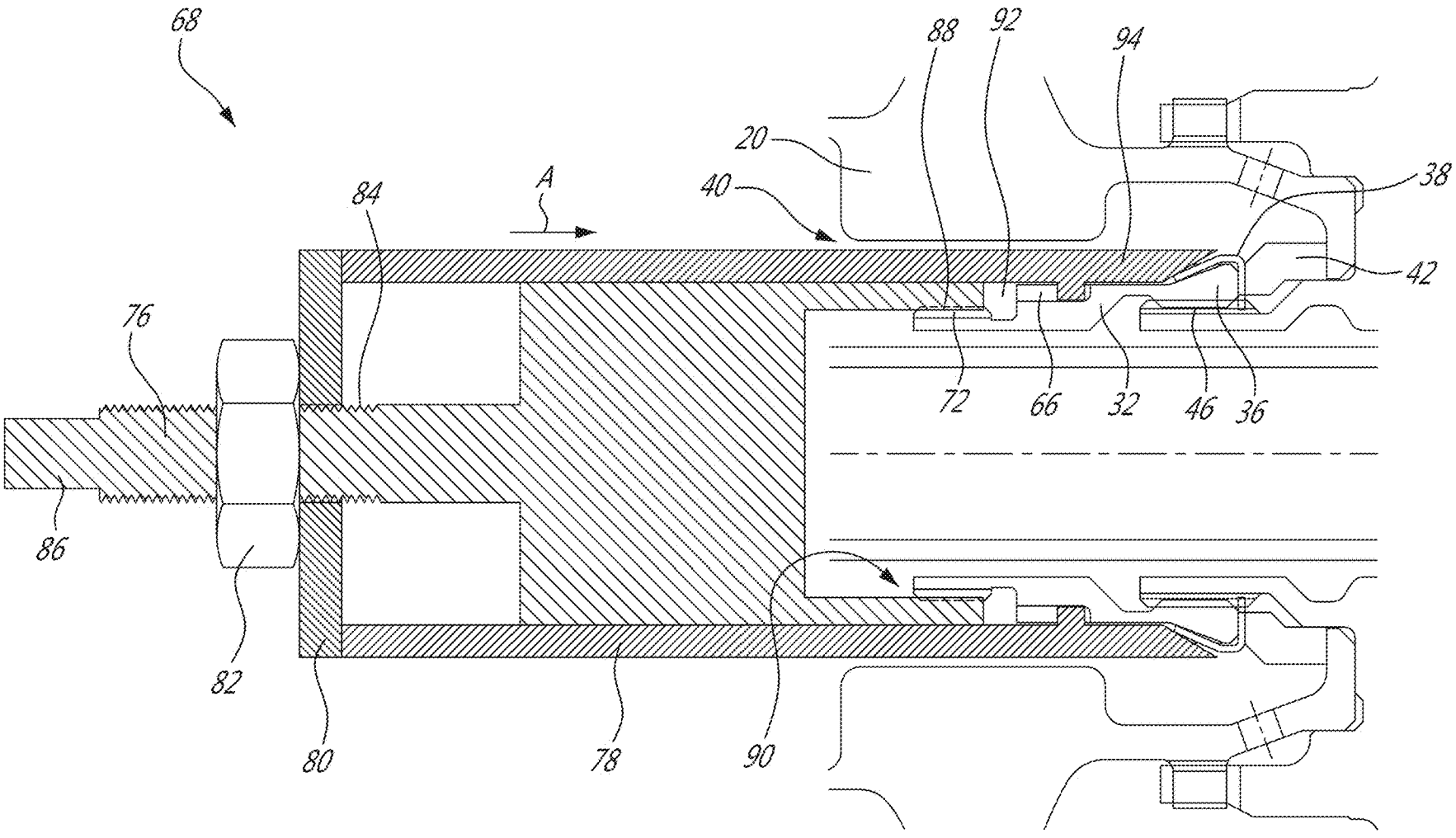
FIG. 9B is another cross-sectional view of the tool shown in FIG. 8 taken along line 9-9 in FIG. 8, shown inserted inside the central bore of the bladed disc and in a state where the retainer has been deformed.

FIGS. 9A and 9B are cross-sectional views of tool 68, shown inserted inside central bore 40 of bladed disc 20. FIG. 9A shows retainer 38 in an undeformed state prior to the (e.g., crimping) operation of tool 68. FIG. 9B shows retainer 38 deformed into recesses 60 formed in shoulder 36 of nut 32 after tool 68 has been used to deform (e.g., crimp) retainer 38. Inner shaft 76 of tool 68 may include means to engage with threaded portion 72 of nut 32 so that linear motion of inner shaft 76 relative to nut 32 may be hindered during operation. For example, inner shaft 76 may have hollow axial end 90 having internally threaded portion 88 for engaging with threaded portion 72 of nut 32.

Outer cylinder 78 may include means to slidingly engage with locking portion 66 of nut 32 so that rotation of outer cylinder 78 relative to nut 32 may be hindered but some linear motion of outer cylinder 78 along central axis 64 (see FIG. 6) of nut 32 may be allowed. In some embodiments, locking portion 66 may have one or more outer flat faces (e.g., defining a hexagonal outer cross-sectional shape) adapted to mate with socket 92 defined inside hollow outer cylinder 78. Such mating between socket 92 and locking portion 66 may hinder rotation of outer cylinder 78 relative to nut 32 during operation.

Outer cylinder 78 may have axial end 94 adapted to apply a biasing force on deformable retainer 38. The biasing force may cause deformable retainer 38 to deform into recesses 60 formed in shoulder 36 of nut 32. In some embodiments, axial end 94 may have inner protrusions aligned with and adapted to cooperate with recesses 60 of nut 32 in order to push portions of retainer 38 into recesses 60 during deformation of retainer 38. In some embodiments, axial end 94 may be tapered.

Tool 68 or some other tool may be used to deform portions of retainer 38 into recesses 60 of nut 32 when nut 32 is threadably engaged with rotor 22, and retainer 38 is clamped between nut 32 and spacer 42. Outer cylinder 78 of tool 68 may have a cross-sectional dimension smaller than the diameter of central bore 40 of bladed disc 20, so that tool 68 can be received into central bore 40 to interface with nut 32. Tool 68 may deform retainer 38 into the recesses 60 formed in shoulder 36 of nut 32 by axially driving outer cylinder 78 of tool 68 against portions of retainer 38 overhanging recesses 60. The tapered end 94 of outer cylinder 78 may push the portion(s) of retainer 38 radially inwardly into respective recesses 60 as outer cylinder 78 is driven axially along arrow A so as to cause local plastic deformation of such portion(s) of retainer 38.

Inner shaft 76 of tool 68 may be threadably engaged with externally threaded portion 72 of nut 32 in order to hinder axial movement of inner shaft 76 relative to nut 32. The engagement of inner shaft 76 with nut 32 via threads 88 and 72 may serve to hold tool 68 in place as outer cylinder 78 is driven to deform retainer 38. Outer cylinder 78 may be slid over inner shaft 76 and engaged with nut 32 so that outer cylinder 78 is engaged with locking portion 66 of nut 32 and axial end 86 of inner shaft 76 is passed through the hole of cap 80 of outer cylinder 78. In some embodiments, cap 80 may be integrally formed with outer cylinder 78 to define a unitary construction. Alternatively, cap 80 and outer cylinder 78 may be separate components releasably assembled together.

Nut 82 of tool 68 may be threadably engaged with external threads 84 on inner shaft 76. Nut 82 may then be turned so that the engagement of nut 82 with threads 84 applies a biasing force on outer cylinder 78 to cause translation of the outer cylinder 78 along arrow A toward shoulder 36 of nut 32. Such translation may cause axial end 94 of outer cylinder 78 to engage and deform portions of retainer 38 radially inwardly into recesses 60.

Figure 10:
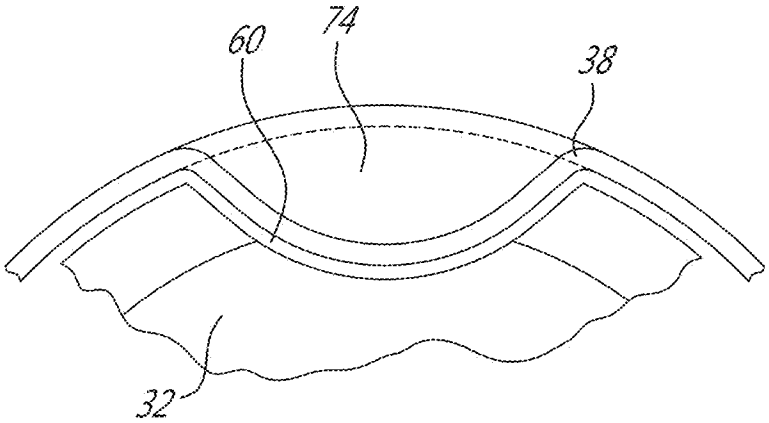
FIG. 10 shows an end-on view of part of the nut with the deformable retainer engaged therewith.

FIG. 10 shows an end-on view of part of nut 32 from a viewed axially from the left side of FIG. 9B. FIG. 10 shows one recess 60 with which a portion of deformable retainer 38 is engaged after retainer 38 has been deformed into recesses 60 using tool 68. Deformable retainer 38 in a deformed state may have recesses 74 corresponding to recesses 60 formed on shoulder 36 of nut 32. Deformed retainer 38 may co-operatingly engage with a periphery of nut 32 in order to hinder rotation of nut 32 relative to rotor 22.

Figure 11:
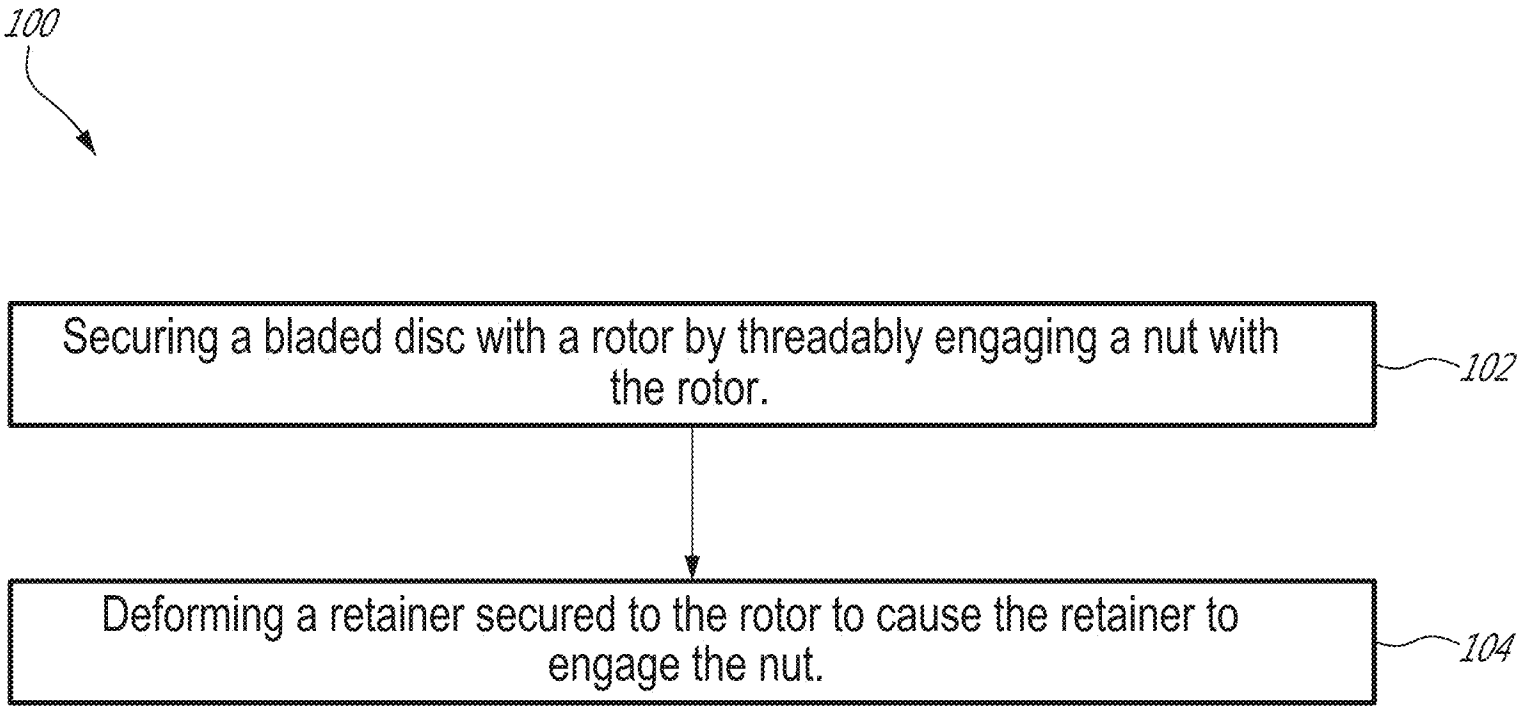
FIG. 11 is a flow chart illustrating a method for securing a bladed disc to a rotor.

FIG. 11 is a flow chart illustrating method 100 for securing bladed disc 20 to rotor 22. Method 100 may be performed using tool 68 or some other suitable tool. Accordingly, aspects of the use of tool 68 described above can be applicable to method 100. Method 100 may comprise:

securing bladed disc 20 to rotor 22 by threadably engaging nut 32 with rotor 22 (see block 102); and deforming retainer 38 to cause retainer 38 to engage nut 32 (see block 104).

Bladed disc 20 may be secured for common rotation with rotor 22 by threadably engaging nut 32 with the rotor 22 to securely clamp bladed disc 20 between nut 32 and rotor 22 with or without intermediate spacer 42.

Retainer 38 may be engaged with rotor 22 to hinder rotation of retainer relative to rotor 22. The deforming may include driving a tool (e.g., outer cylinder 78 of tool 68) against retainer 38 to cause deformation of retainer 38. Driving the tool may include using nut 32 to apply a driving force on the tool.

Nut 32 may be coaxial with rotor 22 and may be disposed inside central bore 40 of bladed disc 20. Method 100 may comprise axially driving the tool relative to nut 32 and radially deforming retainer 38 using the tool. Threaded portion 72 of nut 32 may be used to apply the biasing force on the tool. Method 100 may comprise securing the tool to nut 32 to hinder rotation of tool relative to nut 32 while driving the tool.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A turbine assembly comprising:

a rotor;

a turbine disc;

a nut threadably engaged with the rotor and securing the turbine disc to the rotor; and a deformed retainer co-operatingly engaging with a periphery of the nut and configured to hinder rotation of the nut relative to the rotor;

wherein:

the nut has a first threaded portion threadably engaged with the rotor; and the nut has a second threaded portion for engagement with a tool for deforming the deformed retainer.

2. The turbine assembly as defined in claim 1, wherein the nut is disposed inside a central bore of the turbine disc.

3. The turbine assembly as defined in claim 1, wherein:

the turbine disc is a first turbine disc; and the rotor is a second turbine disc.

4. The turbine assembly as defined in claim 1, wherein:

the rotor has an externally threaded portion; and the first threaded portion of the nut is an internally threaded portion engaged with the externally threaded portion of the rotor.

5. The turbine assembly as defined in claim 1, wherein:

the first threaded portion of the nut is an internally threaded portion; and the second threaded portion of the nut is an externally threaded portion.

6. The turbine assembly as defined in claim 1, wherein the first and second threaded portions of the nut are disposed at opposite axial ends of the nut.

7. The turbine assembly as defined in claim 1, wherein the periphery of the nut includes one or more recesses at least partially occupied by the deformed retainer.

8. The turbine assembly as defined in claim 7, wherein the one or more recesses are axially tapered.

9. The turbine assembly as defined in claim 1, wherein the deformed retainer is engaged with the rotor to hinder rotation of the deformed retainer relative to the rotor.

10. A gas turbine engine comprising:

a rotor;

a bladed disc;

a nut threadably engaged with the rotor and securing the bladed disc to the rotor; and a deformed retainer co-operatingly engaging with a shoulder of the nut and configured to hinder rotation of the nut relative to the rotor;

wherein:

the nut has a first threaded portion threadably engaged with the rotor; and the nut has a second threaded portion for use with a tool for deforming the deformed retainer.

11. The gas turbine engine as defined in claim 10, wherein the nut is coaxial with the rotor and is disposed inside a central bore of the bladed disc.

12. The gas turbine engine as defined in claim 10, wherein the first and second threaded portions of the nut are disposed at opposite axial ends of the nut.

13. The gas turbine engine as defined in claim 12, wherein the shoulder of the nut includes one or more recesses at least partially occupied by the deformed retainer.

14. A method for securing a bladed disc to a rotor, the method comprising:

securing the bladed disc to the rotor by threadably engaging a nut with the rotor; and deforming a retainer to cause the retainer to engage the nut, the retainer being engaged with the rotor to hinder rotation of the retainer relative to the rotor, the deforming including driving a tool against the retainer to cause deformation of the retainer, driving the tool including using the nut to apply a force on the tool.

15. The method as defined in claim 14, wherein the nut is coaxial with the rotor and is disposed inside a central bore of the bladed disc.

16. The method as defined in claim 15, comprising axially driving the tool relative to the nut and radially deforming the retainer with the tool.

17. The method as defined in claim 16, comprising securing the tool to the nut to hinder rotation of the tool relative to the nut while driving the tool.

18. The method as defined in claim 14, comprising using a threaded portion of the nut to apply the force on the tool.

* * * * *